US005851157A

United States Patent [19]

Koide et al.

[11] Patent Number: 5,851,157

[45] Date of Patent: Dec. 22, 1998

[54] IRON CLUB FOR GOLF

[75] Inventors: Hiroichi Koide; Sadatsugu Shimizu, both of Sanjo; Ikuo Nakazawa, Nagaoka, all of Japan

[73] Assignee: BMGA Co., Ltd., Niigata-ken, Japan

[21] Appl. No.: 653,240

[22] Filed: May 24, 1996

[51] Int. Cl.[6] ..... A63B 53/02; A63B 53/04

[52] U.S. Cl. ..... 473/305; 473/311; 473/314; 473/345

[58] Field of Search ..... 473/345, 305, 473/306, 307, 308, 309, 310, 311, 314, 340, 341, 324

[56] References Cited

U.S. PATENT DOCUMENTS

| | | | |
|---|---|---|---|
| 3,539,184 | 11/1970 | Koorland | 473/290 |
| 3,967,826 | 7/1976 | Judice | 473/313 |
| 4,650,191 | 3/1987 | Mills | 473/341 |
| 5,193,811 | 3/1993 | Okumoto | 473/349 |
| 5,280,923 | 1/1994 | Lu | 473/314 |
| 5,556,097 | 9/1996 | Endo | 473/309 |
| 5,586,947 | 12/1996 | Hutin | 473/345 |

FOREIGN PATENT DOCUMENTS

| | | |
|---|---|---|
| 2-41009 | 10/1990 | Japan . |
| 594078320 | 11/1994 | Japan . |
| 6-323557 | 6/1996 | Japan . |
| 2181657 | 4/1987 | United Kingdom . |

*Primary Examiner*—Sebastiano Passaniti
*Assistant Examiner*—Stephen L. Blau
*Attorney, Agent, or Firm*—Pollock, Vande Sande & Priddy

[57] ABSTRACT

To provide an easy-to-use iron club having a low gravitational center, a hosel portion (12) is formed on a base proximal end portion of a face (13) of a head portion (11), and a shaft hole (14) which penetrates from an upper end of the hosel portion (12) to a lower surface of the head portion (11) or does not penetrate to the lower surface of the head portion (11). A shaft (21) is inserted into the shaft hole (14).

8 Claims, 7 Drawing Sheets

IRON CLUB FOR GOLF

BACKGROUND OF THE INVENTION

The present invention relates to an iron club for golf.

As shown in FIG. 10, a conventional iron club is composed of a shaft 53 having at its upper end a grip and a head having, at its upper side, a hosel portion 54 projected upwardly and coupled with the shaft 53 at a base portion (i.e., a neck portion 55) of a head portion 52 provided with a face surface 51. A lower end portion of the shaft 53 is connected to the hosel portion 54 to form the club. In particular, the joining the shaft 53 and the hosel portion 54 is carried out by inserting the shaft 53 into an insert hole 54*a* formed in the hosel portion 54.

Also, in connection with forming a head portion and a hosel portion it is known that the components parts are formed by casting or forging, or otherwise. More particularly a face portion 56, a head body portion 57 and a hose portion 58 (neck portion) may be forged separately (see FIG. 11). Thereafter a head portion is formed by assembling these components (see FIG. 12) as disclosed in Japanese Utility Model Examined Publication No. Hei 2-41009.

If the head of an iron gulf club has a lower gravitational center, it is easy even for beginner to hit well a ball, and it is likely that the ball may climb high when the ball is hit. Accordingly, in the conventional iron club, many techniques are used to lower the center of gravity of the head. For example, a lower portion of the head portion is thickened or an upper portion of the head portion is thinned, or a cross-section of the head portion is designed so that the lower portion weighs heavy and the upper portion weighs light, or the head portion as a whole is made hollow to thereby reduce the overall weight and at the same time, the position of the gravity center is adjusted by controlling the thickness of the head portion.

However, with the conventional attempts, the hosel portion is integrally formed upwardly from the base portion (neck portion) of the head portion and a sufficient joint strength must be maintained. Accordingly, rather large thickness and length are required for the hosel portion. For this reason, there is a limit for making the center of gravity of the overall head (including the hosel portion) located at a low position.

SUMMARY OF THE INVENTION

Accordingly, an object of the invention is to provide an iron club in which a sufficient joint strength between a head and a shaft may be secured and at the same time, a center of gravity may be readily located at a low position.

According to a first aspect of the invention, there is provided an iron golf club comprising a head portion having a predetermined shape with a face, and a shaft integrally formed with the head portion, wherein a lower edge of a hosel portion is integrally formed with a base proximal end of the face, the hosel portion projects upwardly therefrom and the shaft is suitably integrally formed with the hosel portion.

Alternatively, a suitable shaft is inserted and fixed to a shaft hole formed in the hosel portion.

As a further alternative, a shaft hole passes through from an upper end of the hosel portion to a lower surface of the head portion, and the shaft is inserted and fixed to the shaft hole in a suitable manner.

Alternatively, the shaft hole is formed from an upper end of the hosel portion close to a lower surface of the head portion, and the shaft is inserted and fixed to the shaft hole in a suitable manner with the shaft extending close to a bottom of the shalt hole.

Alternatively, the head portion integrally formed with the hosel portion is formed of metal material by casting, forging or grinding.

Alternatively, the head portion and a metal pipe member which is to become the hosel portion are separately formed, and the metal pipe body is integrally formed and inserted into a recess portion formed on the base proximal end portion of the head portion.

Alternatively, the head portion is formed into a hollow member composed of a body portion and a face member, and a metal pipe member to become the hosel portion is integrally inserted into a recess portion formed on the base proximal end side of the head portion.

Alternatively, a projection length of the hosel portion upwardly from the face is shortened as much as possible to thereby attain a low gravity center of the overall head.

Alternatively, a projection length of the hosel portion upwardly from the face is adjusted to a desired length so that the gravity center of the overall head is located at a desired position.

Alternatively, a projection length of the hosel portion forward from the face is shortened as much as possible by forming a lower end face of the hosel portion into a slant surface and attaching the lower end face to the face. This shortens the projection length of the hosel portion forward from the face, in a direction perpendicular from the face, as much as possible.

Alternatively, an axis of the shaft and the head gravity center are located as close as possible.

According to a second aspect of the invention, there is provided an iron club for golf comprising a head portion having a face, and a shaft integrally formed with the head portion, wherein the shaft is not formed through a neck portion formed on a flat surface including the base proximal end portion side of the face, and a hosel portion which is integral with the shaft and is projected on the base proximal end portion side of the face.

Since the lower end of the hosel portion is integrally formed with the face, it is possible to dispense with a portion corresponding to a neck portion of the conventional iron club. Even if the hosel portion having a length required for joint with the shaft is formed, since the upward projection length of the hosel portion from the face is shortened in comparison with the conventional type in which the hosel portion is formed to project upward from the neck portion, the lowering of the center of gravity of the overall head is not prevented.

Furthermore, if the shaft hole is formed to penetrate up to the lower surface of the head portion, even if the upward projection length of the hosel from the face is shortened, it is possible to have a shaft hole which is long enough to keep a sufficient joint strength, and since the shaft hole extends up to the lower surface of the head portion, it is possible to further lower the center of gravity of the overall head.

DESCRIPTION OF THE PREFERRED EMBODIMENTS

Figure 7:
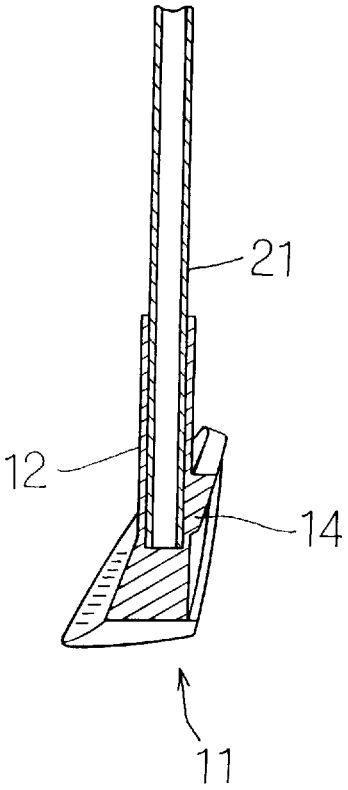
FIG. 7 is a cross-sectional view showing a head according to a second embodiment of the invention.
Figure 8:
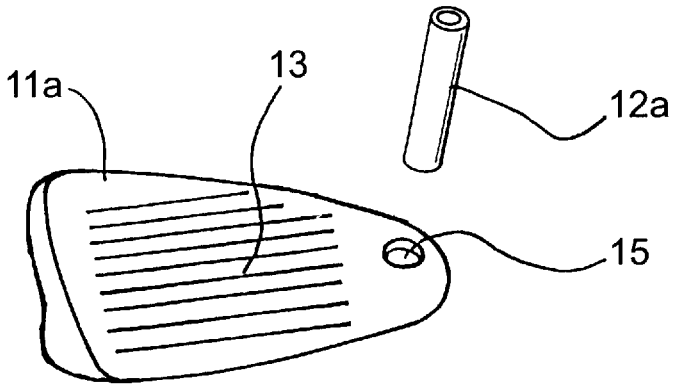
FIG. 8 is an exploded perspective view showing a head according to a third embodiment of the invention.
Figure 9:
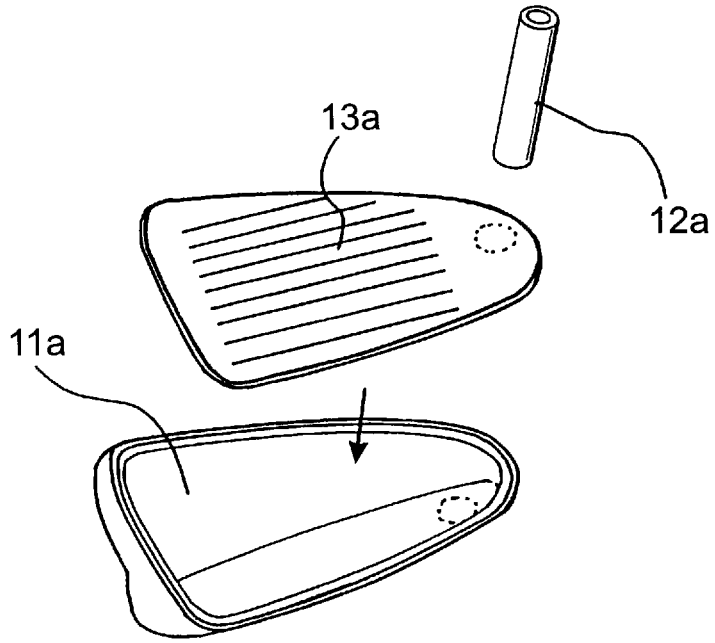
FIG. 9 is an exploded perspective view showing a head according to a fourth embodiment of the invention.
Figure 10:
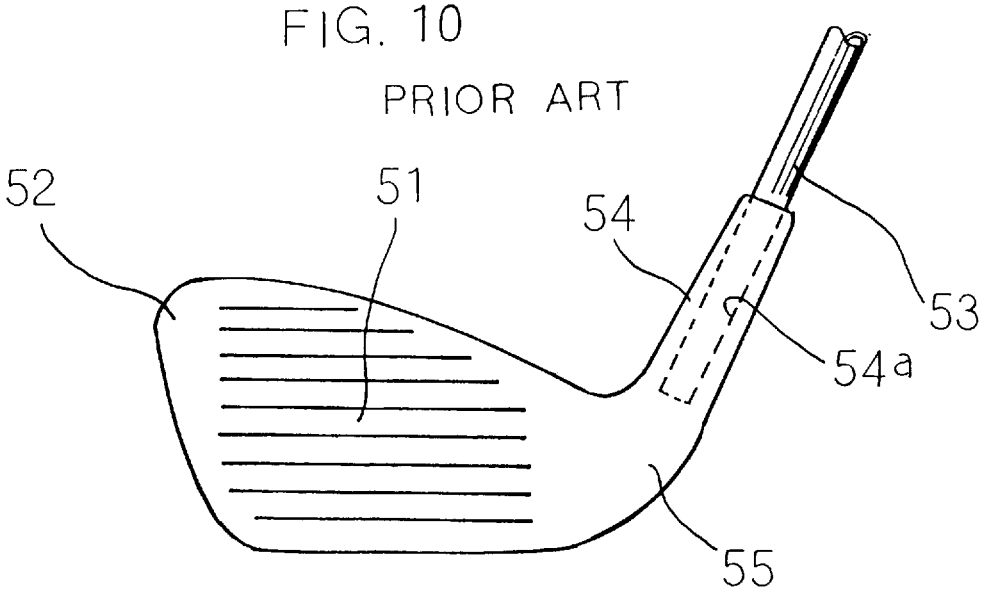
FIG. 10 PRIOR ART
FIG. 10 is an illustration of a head of a conventional iron club.
Figure 11:
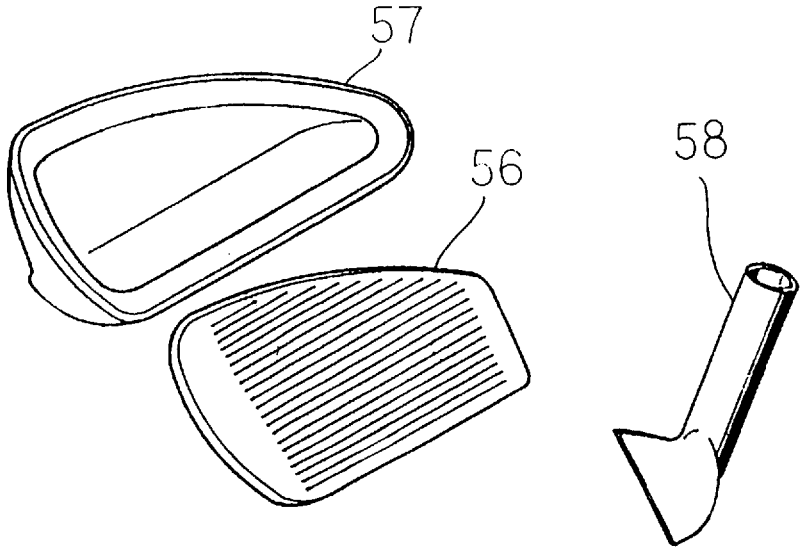
FIG. 11 PRIOR ART
FIG. 11 is another illustration of a head of a conventional iron club.
Figure 12:
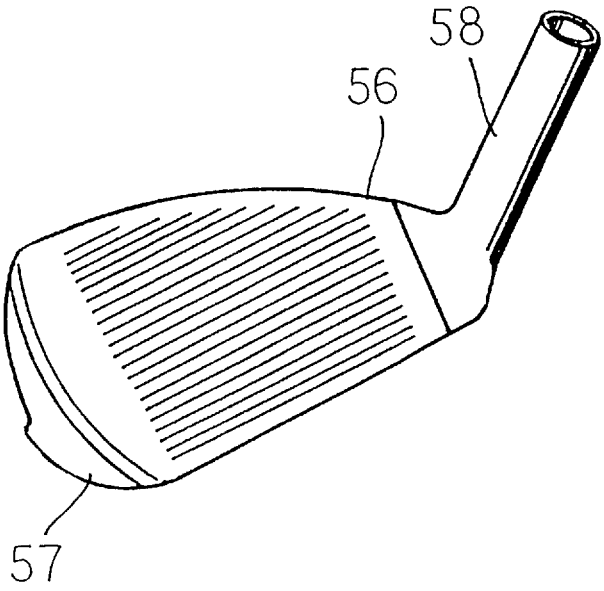
FIG. 12 PRIOR ART
FIG. 12 is still another illustration of the head of the conventional iron club.

The present invention will now be described by way of example with reference to the accompanying drawings. FIGS. 1 through 6 show a first embodiment of the invention, FIG. 7 shows a second embodiment of the invention, FIG. 8 shows a third embodiment of the invention, and FIG. 9 shows a fourth embodiment of the invention.

An iron club according to the first embodiment is composed of a head 1 and a shaft 2 in the same manner as the conventional iron club. The shaft 2 includes a shaft portion 21 made of material such as steel, carbon and boron and a grip portion 22 at an upper end portion of the shaft portion 21 in the same manner as the conventional iron club.

The head 1 of the iron club according to the first embodiment is integrally formed, as a whole, of metal or metallic material by processes such as casting, forging or grinding. The head 1 is composed of a head portion 11 and a hosel portion 12. The head portion 11 has a face 13 (strictly speaking, a hit portion of a central portion of a head portion front face, i. e., a part except for side portions of the head portion front face but a front face of the head portion in this specification). The hosel portion 12 is formed into a slant surface on the base end portion side of the face surface 13 so that a suitable lie angle may be ensured. The hosel portion 12 may be formed to intersect the face 13 to an extent of at least about 270° around a periphery of the hosel.

A shaft hole 14 is formed to penetrate from an upper end of the hosel portion 12 to a lower surface (i.e., so-called sole) of the head portion 11. A lower end portion of the shaft portion 21 is inserted into the shaft through hole 14. Incidentally, reference numeral 15 denotes a screw which closes a lower end of the shaft portion 21.

In the conventional iron club, the hosel portion is formed to project upwardly from the neck portion, and the shaft is inserted into the shaft hole of the hosel portion. Accordingly, if an insert length of the shaft hole is considered in view of a sufficient joint strength with the shaft, a sufficiently long hosel portion is required. However, in the first embodiment, since the shaft through-hole 14 reaches the lower surface (sole portion) of the head portion 11 it is possible to considerably reduce a projection length of the hosel portion 12 upwardly from the face while obtaining the insert length of the shaft portion 21 required to maintain a predetermined joint strength. For this reason, the position of the center of gravity of the head 1 as a whole may be lowered. It is therefore possible to produce the low gravity head and also to adjust the position of the center of gravity, particularly in a vertical direction, by adjusting the length of the hosel portion 12.

Also, the conventional iron club has such a shape that the head is projected on the front side of the shaft. It is necessary to hit the ball at a position remote on the front side from the axis of the hosel portion which holds the swinging shaft. In order to exactly hit the ball, the golfer has to make great efforts. In this point, in the first embodiment, since the shaft axis and the head's center of gravity are very close to each other, the golfer may hit the ball at a position as close as possible to the center of gravity position. It is therefore possible to provide an easy-to-hit iron club with precision.

It is generally said that a so-called goose neck iron club, in which the face is located somewhat on the rear side may be easily to hit. For example, such an iron club may be frequently used and hardly cause a so-called shank action. It is, however, not preferable to locate the face too much on the rear side. In this respect, in the iron club according to the first embodiment, since the hosel portion 12 is formed so that its lower end face is slanted relative to the face 13, it is possible to provide a very easy-to-hit iron club.

Furthermore, the golfer may readily take a stance with the iron club according to the first embodiment. Also, since the head 1 has a low center of gravity, the lower edge of the face 13 enters the lower side of the ball. Therefore, in case of a short iron club, it is likely that the club may impart spin to the ball.

Also, as shown in FIG. 7 showing a second embodiment, if a joint strength between the shaft portion 21 and the head portion 11 is sufficient, it is possible to realize the corresponding lower location of the center of gravity and the suppression of the generation of shank action even in the case where the shaft hole 14 is formed at a predetermined depth but does not penetrate below the hosel portion 12.

Also, as described with the first embodiment, the head 1 is made in a one-piece by casting or the like. However, as shown in FIG. 8, it is possible to separately form a head portion 11*a* and a metal pipe member 12*a* which is to become a hosel portion, in accordance with the third embodiment of the invention. The metal pipe member 12*a* is welded and inserted into a recess 15 formed in the proximal end portion of the head portion 11*a*. Thereafter, the shaft hole may be formed to penetrate therethrough. Of course, in this case, it is possible to select the penetration and the non-penetration of the shaft hole as desired.

Furthermore, FIG. 9 shows the fourth embodiment of the invention. The head portion is formed of an assembly of a body portion 11*b* and face member 13*a* with a hollow space. The pipe member 12*a*, which is to become the hosel portion in the same manner as in the third embodiment, is assembled with this assembly.

According to the present invention, as has been described above, the lower end of the hosel portion is integrally formed on the base proximal end portion of the face of the head so that the hosel portion projects upwardly, and the shaft is coupled with the hosel portion to provide an iron club. Thus, the neck portion is eliminated and a low gravity head may readily be manufactured. It is therefore possible to provide an easier-to-use iron club.

Various details of the invention may be changed without departing from its spirit nor its scope. Furthermore, the foregoing description of the embodiments according to the present invention is provided for the purpose of illustration only, and riot for the purpose of limiting the invention as defined by the appended claims and their equivalents.

What we claim is:

1. A club of the iron type comprising a hosel, a shaft and a head, with a predetermined shape including a face, wherein the hosel projects directly from the face and the shaft is supported in a shaft hole formed in the hosel, wherein the face is substantially planar and wherein the hosel intersects the face to an extent of at least about 270 degrees about a periphery of the hosel, and wherein the shaft has an axis which, when extended downwardly, intersects the face.

2. The club according to claim 1 wherein the shaft hole passes from an upper end of the hosel to a lower surface of the head.

3. The club of claim 1 wherein the head and a metal pipe member, which is to become the hosel, are separately formed and the metal pipe member is inserted into a recess formed on a base end of the head.

4. The club according to claim 1 wherein a projection length of the hosel projecting upwardly from said face is limited so that the center of gravity of the overall head is located at a desired position.

5. The club of claim 1 wherein the hosel is integrally formed with the face and both are formed of metal by casting, forging or grinding.

6. The club of claim 1 wherein the head is formed from a hollow member composed of a body and the face, and the hosel comprises a metal pipe member inserted into a recess formed on a base end of the head.

7. The club of claim 1 wherein the shaft hole extends from an upper end of said hosel to close to a lower surface of said head, with the shaft extending close to a bottom of the shaft hole.

8. The club of claim 1 wherein a lower end face of the hosel is formed into a slant surface corresponding to an incline of the face so that said lower end face of the hosel is attached to said face, whereby a projection length of said hosel projecting upwardly from the face, in a direction perpendicular to said face, is limited.

* * * * *

UNITED STATES PATENT AND TRADEMARK OFFICE

CERTIFICATE OF CORRECTION

PATENT NO. : 5,851,157
DATED : December 22, 1998
INVENTOR(S) : Koide et al

It is certified that error appears in the above-identified patent and that said Letters Patent is hereby corrected as shown below:

Col. 1, line 13, delete "the" before "joining".

Figure 1:
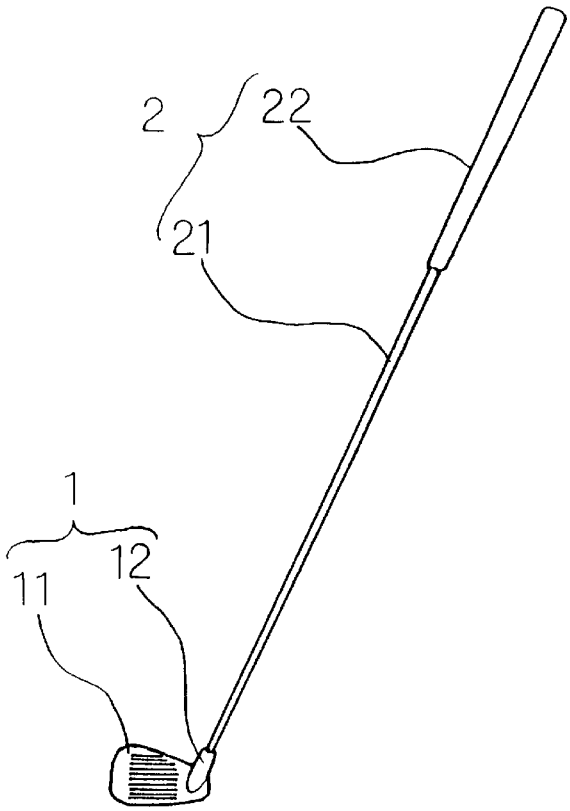
FIG. 1 is an overall frontal view showing an iron club in accordance with a first embodiment of the invention.
Figure 2:
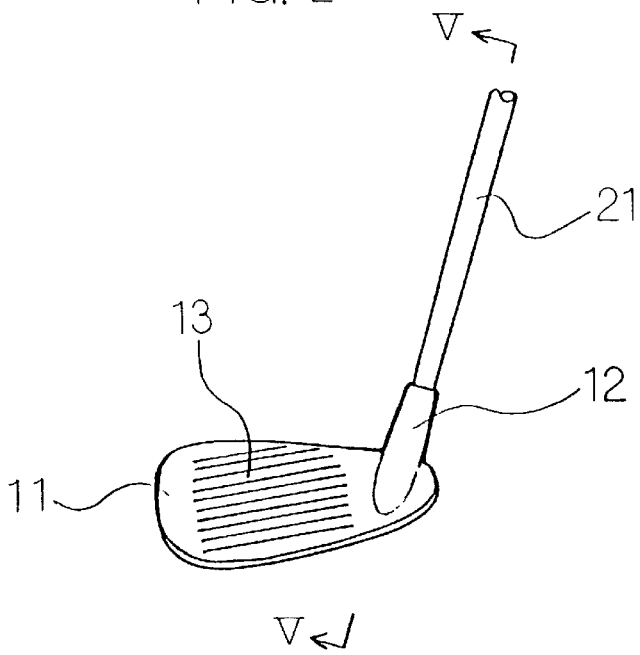
FIG. 2 is an enlarged frontal view showing the head shown in FIG. 1.
Figure 3:
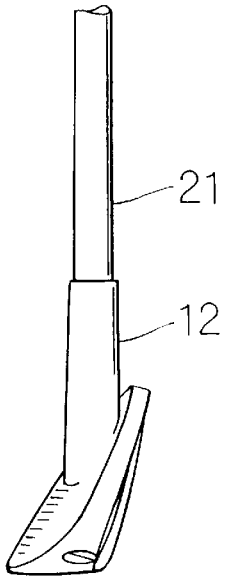
FIG. 3 is an enlarged right side elevational view showing the head in FIG. 1.
Figure 4:
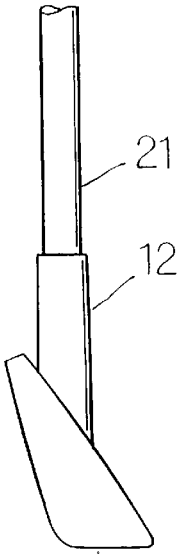
FIG. 4 is an enlarged left side elevational view showing the head in FIG. 1.
Figure 5:
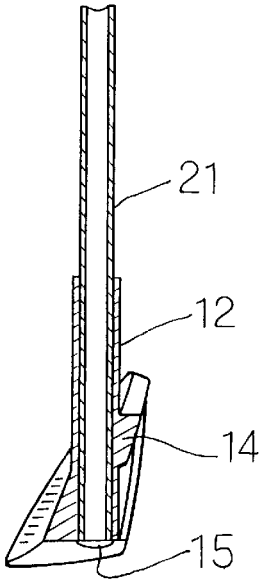
FIG. 5 is a cross-sectional view showing the head shown in FIG. 1, taken along the line V—V of FIG. 2.
Figure 6:
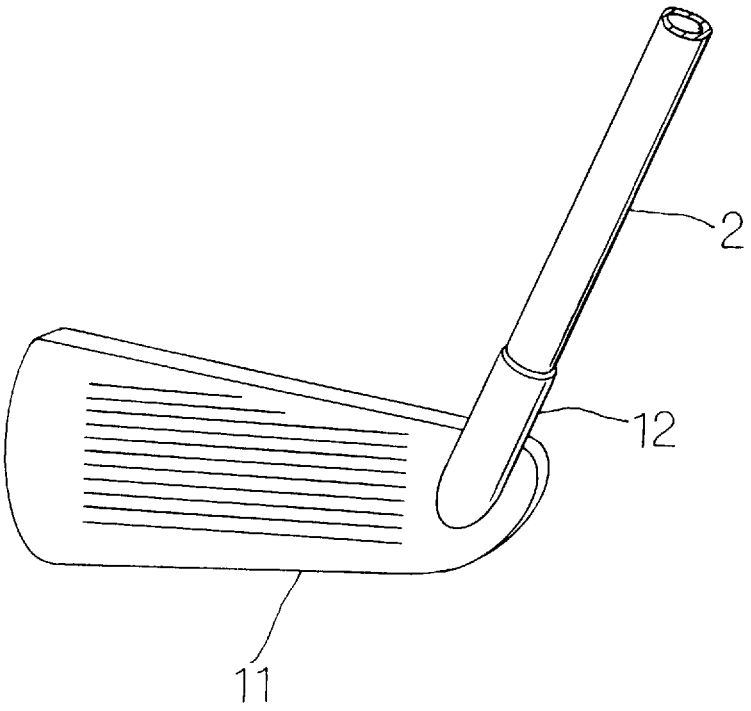
FIG. 6 is an enlarged perspective view showing the head shown in FIG. 1.

Col. 3, line 48, after "hosel." insert "As seen in Figs. 2 and 6, the intersection of the hosel 12 and the face 13 extends about 270° around the periphery of the hosel while that intersection in Figs. 8 and 9 is 360°."

Col. 3, line 56, change "upwardly" to "upward".

Col. 4, line 66, change "riot" to "not".

Signed and Sealed this

Eighteenth Day of May, 1999

*Attest:*

Q. TODD DICKINSON

*Attesting Officer*

*Acting Commissioner of Patents and Trademarks*